US006695503B1

(12) United States Patent
Buxton et al.

(10) Patent No.: US 6,695,503 B1
(45) Date of Patent: Feb. 24, 2004

(54) PRINT MEDIA FEED SYSTEM FOR AN IMAGING APPARATUS

(75) Inventors: Patrick Andrew Buxton, Lexington, KY (US); Ryan Timothy Ward, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/263,027

(22) Filed: Oct. 2, 2002

(51) Int. Cl.[7] ..... B41J 13/02

(52) U.S. Cl. ..... 400/634; 400/602; 400/617; 400/636.2; 400/636.3

(58) Field of Search ..... 400/602, 617, 400/636.2, 636.3, 585.1, 596, 600.3, 625, 628, 637, 634; 271/273

(56) References Cited

U.S. PATENT DOCUMENTS

| | | | | | |
|---|---|---|---|---|---|
| 4,600,929 | A | | 7/1986 | Cardona et al. | 346/134 |
| 5,011,315 | A | | 4/1991 | Kitagawa et al. | 400/624 |
| 5,059,049 | A | * | 10/1991 | Rosenthal | 400/605 |
| 5,194,904 | A | | 3/1993 | Ruch | 355/321 |
| 5,196,863 | A | | 3/1993 | Palmer et al. | 346/76 |
| 5,636,928 | A | * | 6/1997 | Shiina et al. | 400/636 |
| 5,673,074 | A | | 9/1997 | Miyauchi et al. | 347/104 |
| 5,738,454 | A | | 4/1998 | Zepeda et al. | 400/625 |
| 5,797,687 | A | | 8/1998 | Petersen et al. | 400/23 |
| 5,927,877 | A | | 7/1999 | Kelly et al. | 400/625 |
| 6,007,063 | A | | 12/1999 | Park | 271/273 |
| 6,109,745 | A | | 8/2000 | Wen | 347/101 |
| 6,142,049 | A | | 11/2000 | Schweitzer et al. | 83/349 |
| 6,146,036 | A | * | 11/2000 | Kim | 400/629 |
| 6,234,472 | B1 | | 5/2001 | Juan | 271/194 |
| 6,238,113 | B1 | | 5/2001 | Dodge | 400/613 |
| 6,239,817 | B1 | | 5/2001 | Meyer | 347/36 |
| 6,318,854 | B1 | | 11/2001 | Rasmussen et al. | 347/104 |
| 6,336,759 | B1 | | 1/2002 | Nakano | 400/625 |
| 6,341,861 | B1 | | 1/2002 | Sasaki | 347/104 |
| 6,382,850 | B1 | * | 5/2002 | Freund et al. | 400/118.2 |
| 6,386,536 | B1 | | 5/2002 | Juan | 271/276 |
| 6,598,870 | B2 | * | 7/2003 | Hanano | 271/138 |
| 2001/0055108 | A1 | | 12/2001 | Kuo et al. | 355/72 |
| 2002/0006300 | A1 | | 1/2002 | Kawaguchi | 400/118.2 |

* cited by examiner

*Primary Examiner*—Andrew H. Hirshfeld
*Assistant Examiner*—Dave A. Ghatt
(74) *Attorney, Agent, or Firm*—Taylor & Aust, P.C.

(57) ABSTRACT

A print media feed system for advancing a sheet of print media having a leading edge and a trailing edge in a sheet feed direction through a print zone in an imaging apparatus includes a rotating support positioned downstream of an exit roller in relation to a sheet feed direction. The rotating support provides a rotating support surface that engages a non-printed side of the sheet of print media downstream of the exit roller while the trailing edge of the sheet of print media is advanced through the print zone by the exit roller, the rotating support not contributing to advance the trailing edge of the sheet of print media through the print zone, but contributing to advance the sheet of print media after the sheet of print media is released by the exit roller.

20 Claims, 5 Drawing Sheets

PRINT MEDIA FEED SYSTEM FOR AN IMAGING APPARATUS

BACKGROUND OF THE INVENTION

1. Field of the Invention.

The present invention relates to an imaging apparatus, and more particularly, to a print media feed system for an imaging apparatus.

2. Description of the Related Art.

A typical ink jet printer forms an image on a print medium by ejecting ink from a plurality of ink jetting nozzles of an ink jet printhead to form a pattern of ink dots on the print medium. Such an ink jet printer typically includes a reciprocating printhead carrier that transports one or more ink jet printheads across the print medium along a bi-directional scanning path defining a print zone of the printer. Typically, the mid-frame provides media support at or near the print zone. A sheet feeding mechanism is used to incrementally advance the print medium sheet in a sheet feed direction, also commonly referred to as a sub-scan direction or vertical direction, through the print zone between scans in the main scan direction, or after all data intended to be printed with the print medium at a particular stationary position has been completed.

One such sheet feed mechanism includes a feed roller and corresponding pinch roller arrangement located upstream of the print zone, and an exit roller and corresponding exit pinch roller arrangement, such as a plurality of star wheels, located downstream of the print zone. The exit roller is often slightly over-driven to place the sheet in a state of slight tension during printing. Following printing, the sheet is advanced to an exit tray by the exit roller. Such a sheet feed mechanism, however, does not easily permit printing adjacent the trailing edge of the sheet, as in attempting borderless printing, since as the sheet is released from the feed roller, the sheet lunges forward due to the state of tension of the sheet. Also, once the sheet is released by the feed roller, the trailing edge of the sheet tends to rise toward the printhead, a phenomena commonly referred to as "tail-flip", thereby decreasing the distance between the printhead and the sheet, and thereby adversely affecting printing quality.

In order to provide more control of the position of the print medium sheet during printing, another sheet feed mechanism includes a feed roller and corresponding pinch roller arrangement located upstream of the print zone, a first exit roller and corresponding exit pinch roller arrangement located downstream of the print zone, and a second exit roller and corresponding exit pinch roller arrangement positioned downstream from the first exit roller/pinch roller arrangement. In this sheet feed mechanism, the second exit roller, i.e., the exit roller furthest downstream from the print zone, is designed to be of high precision in comparison to the lower precision first exit roller, and thus the further downstream feed roller controls the advancement of the sheet through the print zone following release of the sheet by the feed roller.

One disadvantage of the sheet feed mechanism having two exit roller/exit pinch roller pairs is the increased cost of providing the second downstream exit roller/exit pinch roller pair. Another disadvantage is that, in addition to the first exit pinch roller arrangement, the second exit pinch roller arrangement also contacts the printed side of the sheet, thereby increasing the risk of damage to the printed image.

What is needed in the art is a print media feed system that provides precise control of the position of a sheet of print media following release by the feed roller without the need of a second exit pinch roller arrangement.

SUMMARY OF THE INVENTION

The present invention relates to a print media feed system that provides precise control of the position of a sheet of print media following release by the feed roller without the need of a second exit pinch roller arrangement.

The present invention, in one form thereof, is directed to a print media feed system for advancing a sheet of print media having a leading edge and a trailing edge in a sheet feed direction through a print zone in an imaging apparatus. A drive unit provides a rotational force. A feed roller is coupled to the drive unit. The feed roller is positioned upstream from the print zone in relation to the sheet feed direction. An exit roller is coupled to the drive unit. The exit roller is positioned downstream from the print zone in relation to the sheet feed direction. An exit pinch roller arrangement is positioned adjacent the exit roller. The exit roller and the exit pinch roller arrangement cooperate to advance the trailing edge of the sheet of print media through the print zone. A rotating support is coupled to the drive unit. The rotating support is positioned downstream of the exit roller in relation to the sheet feed direction. The rotating support provides a rotating support surface that engages a non-printed side of the sheet of print media downstream of the exit roller while the trailing edge of the sheet of print media is advanced through the print zone by the exit roller, the rotating support not contributing to advance the trailing edge of the sheet of print media through the print zone, but contributing to advance the sheet of print media after the sheet of print media is released by the exit roller.

An advantage of the present invention is reduction of component count and associated costs over that of systems that include multiple exit roller/exit pinch roller pairs.

Another advantage of the present invention is reduction of the risk of damage to the printed image as the sheet of print media is advanced to the exit tray over that of systems that include multiple exit roller/exit pinch roller pairs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
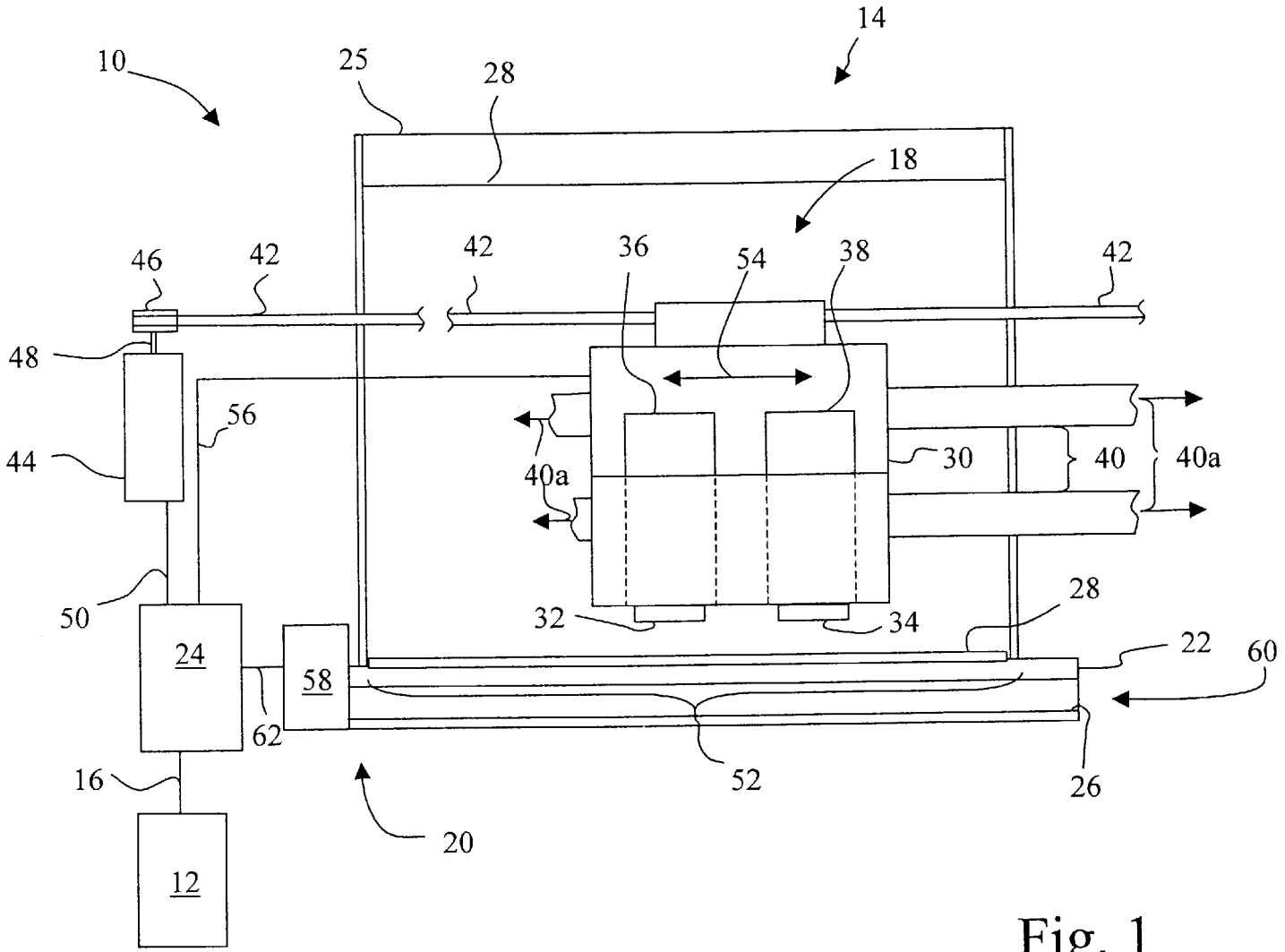
FIG. 1 is a diagrammatic representation of an imaging apparatus embodying the present invention.

Referring now to the drawings and more particularly to FIG. 1, there is shown an imaging system 10 embodying the present invention.

Imaging system 10 includes computer 12 and an imaging apparatus 14, such as for example an ink jet printer, which also will be referenced by element number 14. Computer 12 is communicatively coupled to ink jet printer 14 by way of communications link 16.

Communications link 16 may be established by, for example, a direct connection, such as a cable connection, between ink jet printer 14 and computer 12; by a wireless connection; or by a network connection, such as for example, an Ethernet local area network (LAN) or a wireless networking standard, such as IEEE 802.11.

Computer 12 is typical of that known in the art, and includes a display, an input device such as a keyboard, a processor and associated memory. Resident in the memory of computer 12 is printer driver software. The printer driver software places print data and print commands in a format that can be recognized by ink jet printer 14. The format can be, for example, a data packet including print data and printing commands for a given area such as a print scan and includes a print header that identifies the scan data.

Ink jet printer 14 includes a printhead carrier system 18, a print media feed system 20, a mid-frame 22, a controller 24, a print media source 25 and an exit tray 26.

Print media source 25 is configured and arranged to supply individual sheets of print media 28 to print media feed system 20, which in turn further transports the sheets of print media 28 during a printing operation.

Printhead carrier system 18 includes a printhead carrier 30 for carrying a color printhead 32 and black printhead 34. A color ink reservoir 36 is provided in fluid communication with color printhead 32 and a black ink reservoir 38 is provided in fluid communication with black printhead 34. Reservoirs 36, 38 may be located near respective printheads 32 and 34, which in turn may be assembled as respective unitary cartridges. Alternatively, reservoirs 36, 38 may be located remote from printheads 32, 34, e.g., off-carrier, and reservoirs 36, 38 may be fluidly interconnected to printheads 32, 34, respectively, by fluid conduits. Printhead carrier system 18 and printheads 32 and 34 may be configured for unidirectional printing or bi-directional printing.

Printhead carrier 30 is guided by a pair of guide rods 40. Alternatively, one of guide rods 40 could be a guide rail made of a flat material, such as metal. The axes 40*a* of guide rods 40 define a bi-directional-scanning path, also referred to as 40*a*, of printhead carrier 30. Printhead carrier 30 is connected to a carrier transport belt 42 that is driven by a carrier motor 44 by way of a driven carrier pulley 46. Carrier motor 44 has a rotating carrier motor shaft 48 that is attached to carrier pulley 46. Carrier motor 44 is electrically connected to controller 24 via communications link 50. At a directive of controller 24, printhead carrier 30 is transported, in a reciprocating manner, along guide rods 40. Carrier motor 44 can be, for example, a direct current motor or a stepper motor.

The reciprocation of printhead carrier 30 transports ink jet printheads 32 and 34 across the sheet of print media 28 along bi-directional scanning path 40*a* to define a print zone 52 of printer 14 as a rectangular region. This reciprocation occurs in a scan direction 54 that is parallel with bi-directional scanning path 40*a* and is also commonly referred to as the horizontal scanning direction. Printheads 32 and 34 are electrically connected to controller 24 via communications link 56.

During each printing pass, i.e., scan, of printhead carrier 30, while ejecting ink from printheads 32 and/or 34, the sheet of print media 28 is held stationary by print media feed system 20. Before ink ejection begins for a subsequent pass, print media feed system 20 conveys the sheet of print media 28 in an incremental, i.e., indexed, fashion to advance the sheet of print media 28 into print zone 52. Following printing, the printed sheet of print media 28 is delivered to print media exit tray 26.

Print media feed system 20 includes a drive unit 58 coupled to a sheet handling unit 60. Drive unit 58 is electrically connected to controller 24 via communications link 62, and provides a rotational force which is supplied to sheet handling unit 60.

Figure 2:
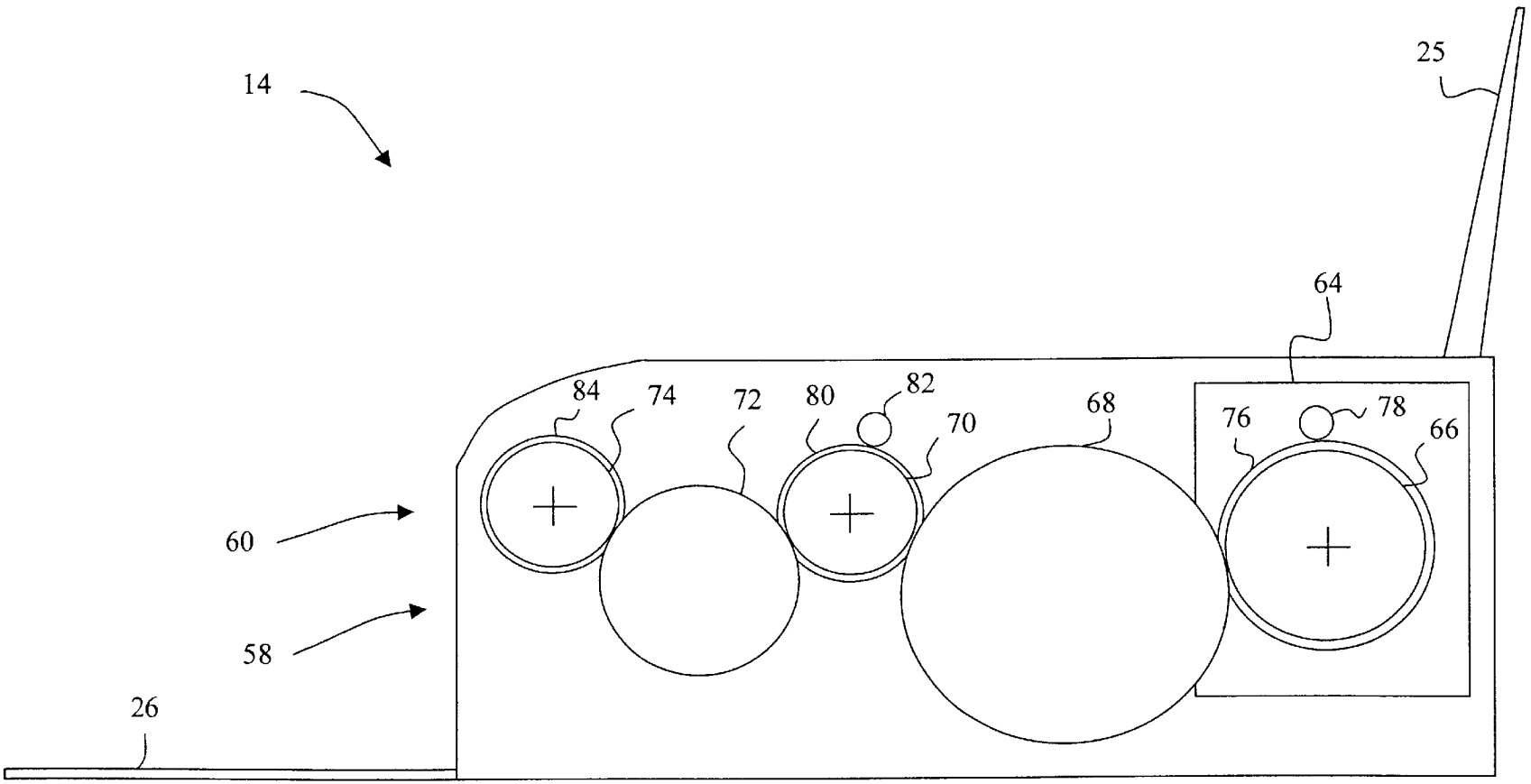
FIG. 2 is a diagrammatic representation of the print media feed system of the imaging apparatus of FIG. 1.

Referring to FIG. 2, there is shown a diagrammatic representation of imaging apparatus 14 including print media feed system 20.

Drive unit 58 includes a motor 64, a feed roller gear 66, a first transmission gear 68, an exit roller gear 70, a second transmission gear 72, and a rotating support gear 74. Sheet handling unit 60 includes a feed roller 76, a pinch roller arrangement 78, an exit roller 80, an exit pinch roller arrangement 82, and a rotating support 84.

Feed roller 76 is coupled at a first end to motor 64 of drive unit 58, and coupled at a second end to feed roller gear 66. Exit roller 80 is coupled to exit roller gear 70 of drive unit 58. Rotating support 84 is coupled to rotating support gear 74 of drive unit 58. In the arrangement, as shown, the number of teeth of each of feed roller gear 66 and exit roller gear 70 are selected so that the respective surface rotational velocities of feed roller 76 and exit roller 80 are preferably equal, but at least substantially equal. Also, the number of teeth of each of exit roller gear 70 and rotating support gear 74 are selected so that the respective surface rotational velocities of exit roller 80 and rotating support 84 are preferably equal, but at least substantially equal. By substantially equal, it is meant that the respective surface rotational velocities are within ±0.1 percent.

Figure 3:
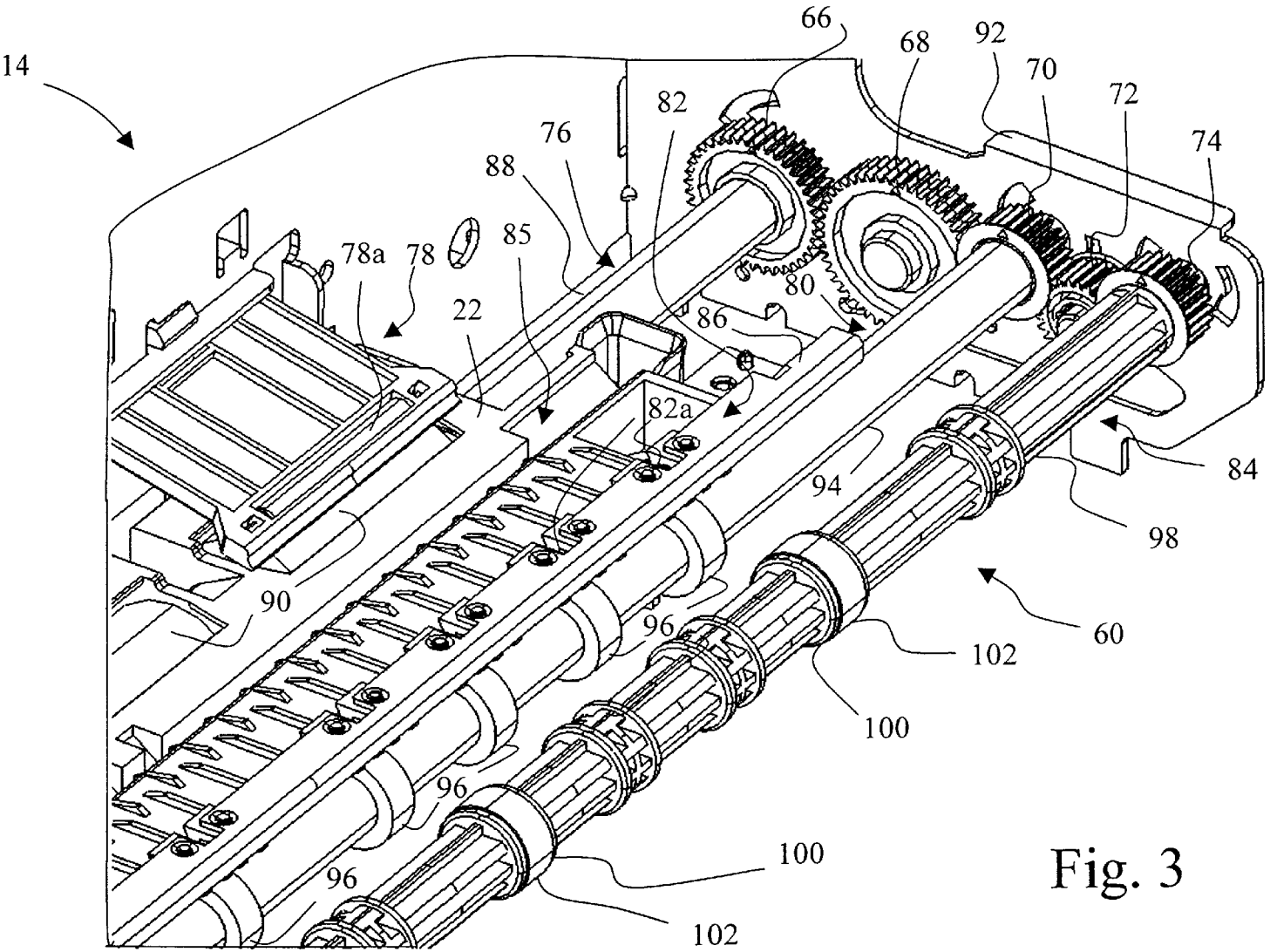
FIG. 3 is a perspective view of a broken out portion of the imaging apparatus of FIG. 1.

FIG. 3 is a perspective view of a portion of imaging apparatus 14, including mid-frame 22, and media handling unit 60. Mid-frame 22 includes a plurality of media support ribs 85. Mid-frame 22 also includes a support bar 86 for mounting exit pinch roller arrangement 82. Exit pinch roller arrangement 82 may be, for example, individually mounted star-wheels 82*a*.

Feed roller 76 includes a metal shaft 88 on which is mounted a plurality of precision feed roller tires 90. Feed roller tires 90 may be, for example, made from EPDM (ethylene propylene diene monomer) rubber and precision ground to a diameter of 22.06 millimeters with a tolerance of ±0.02 millimeters. To avoid electrostatic buildup on feed roller tires 90, metal shaft 88 is electrically grounded to printer frame 92. Pinch roller arrangement 78 includes a plurality of pinch rollers 78*a* (only one shown), each positioned adjacent to a corresponding feed roller tire 90.

Exit roller 80 includes a metal shaft 94 on which is mounted a plurality of precision exit roller tires 96. Exit roller tires 96 may be, for example, made from EPDM rubber and precision ground to a diameter of 13.75 millimeters with a tolerance of ±0.02 millimeters. To avoid electrostatic buildup on exit roller tires 96, metal shaft 94 is electrically grounded to printer frame 92.

Rotating support 84 includes a plastic shaft 98 on which is mounted a plurality of rotating support tires 100. Rotating support tires 100 may be, for example, made from a soft rubber, such as isoprene rubber, having a diameter of 13.75 millimeters, with a tolerance of ±0.2 millimeters and thus, need not be precision ground. Rotating support tires 100 have an outer periphery that defines a rotating support surface 102. Due to the absence of any backup roller, or pinch roller, rotating support tires 100 are made from a material that is selected so that the coefficient of friction between rotating support tires 100 and the sheet of print media due to the weight of the sheet of print media 28 is sufficient to transport the sheet of print media 28, once released by exit roller 80, to exit tray 26.

Figure 4:
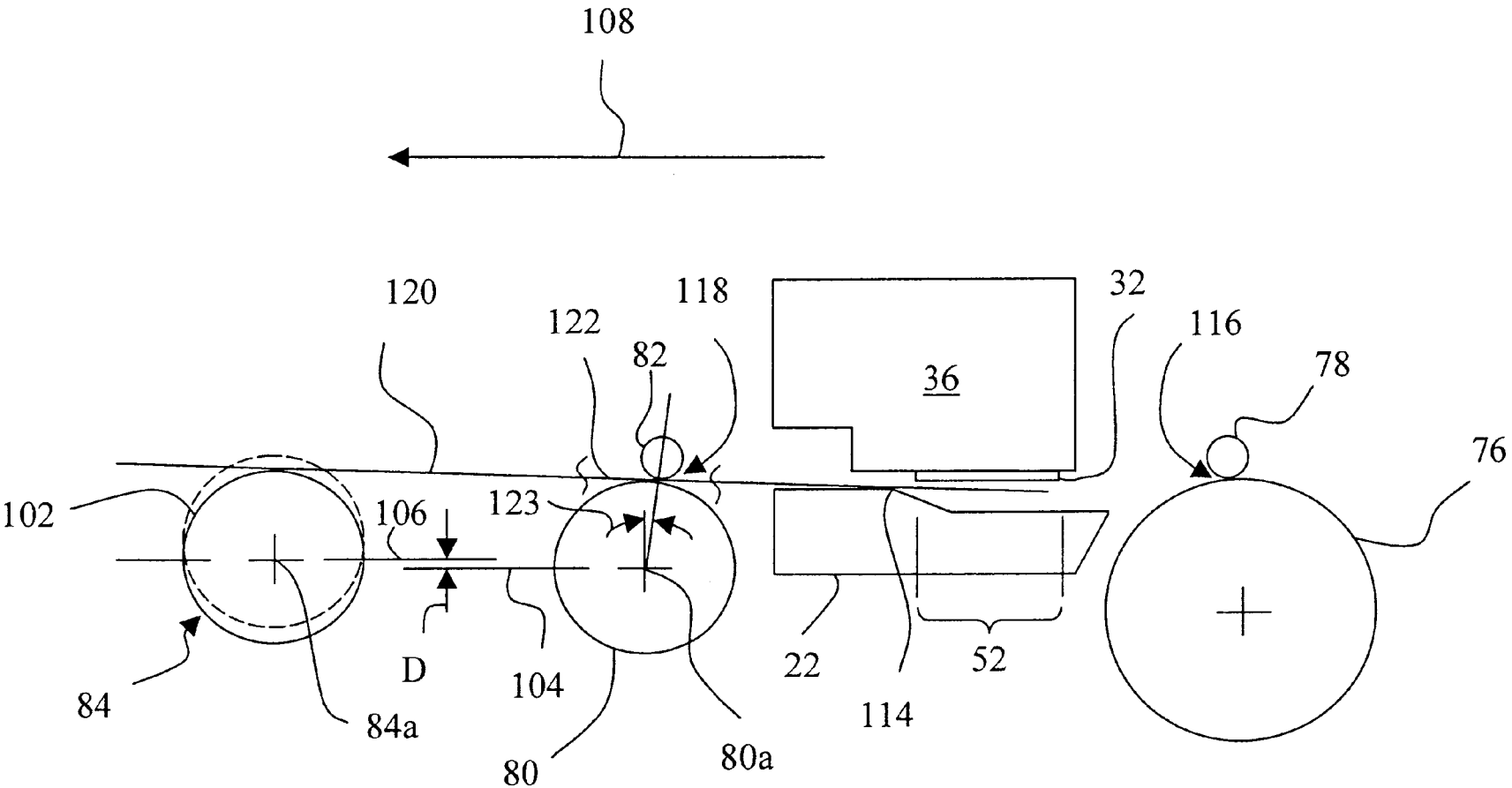
FIG. 4 is a diagrammatic representation of the print media feed system of the imaging apparatus of FIG. 1 showing an orientation of the rotating support, exit roller, mid-frame and feed roller.

FIG. 4 is a diagrammatic representation showing an orientation of rotating support 84, exit roller 80, mid-frame 22 and feed roller 76. As shown, the respective diameters of exit roller 80 and rotating support 84 are substantially equal, however, their respective axes 80*a*, 84*a* are vertically spaced by a distance D with respect to respective horizontal planes 104, 106. Distance D may be, for example, 0.5 millimeters.

Feed roller 76 is positioned upstream from print zone 52 in relation to a sheet feed direction 108 of the sheet of print media 28. Exit roller 80 is positioned downstream from print zone 52 in relation to sheet feed direction 108. Rotating support 84 is positioned downstream of exit roller 80 in relation to sheet feed direction 108. Mid-frame 22 is positioned in print zone 52. Mid-frame 22 includes a stationary support surface 114 for engaging a non-printed side of the sheet of print media 28.

Feed roller 76 and its corresponding pinch roller arrangement 78 form a feed roller nip 116. Exit roller 80 and its corresponding exit pinch roller arrangement 82 form an exit roller nip 118. Stationary support surface 114 and exit roller nip 118 define a plane 120 that extends toward rotating support 84. Further, as shown in FIG. 4, plane 120 is oriented so as to be non-parallel with either of planes 104, 106.

As shown in FIG. 4, rotating support surface 102 of rotating support 84 is positioned to be tangentially co-planar with plane 120, i.e., plane 120 intersects rotating support surface 102 at a tangential point. However, alternatively, it is contemplated that by varying distance D, rotating support surface 102 of rotating support 84 may be positioned, as shown by dashed lines, such that rotating support surface 102 is not co-planar with plane 120, and may be positioned such that plane 120 intersects rotating support 84.

As shown in FIG. 4, exit roller nip 118 defines a tangential plane 122 of exit roller 80. Tangential plane 122 may be oriented to be co-planar with rotating support surface 102 of rotating support 84. In FIG. 4, each of plane 120 and tangential plane 122 is arranged to be co-planar. However, by varying the angular relationship 123 between exit roller 80 and exit pinch roller arrangement 82, the orientation of tangential plane 122 will be rotated with respect to axis 80*a*, such that plane 120 and tangential plane 122 are no longer co-planar. Further, the angular relationship between exit roller 80 and exit pinch roller arrangement 82, and the distance D, can be selected such that tangential plane 122 will tangentially intersect rotating support surface 102, even though that plane 120 and tangential plane 122 are no longer co-planar.

Figure 5:
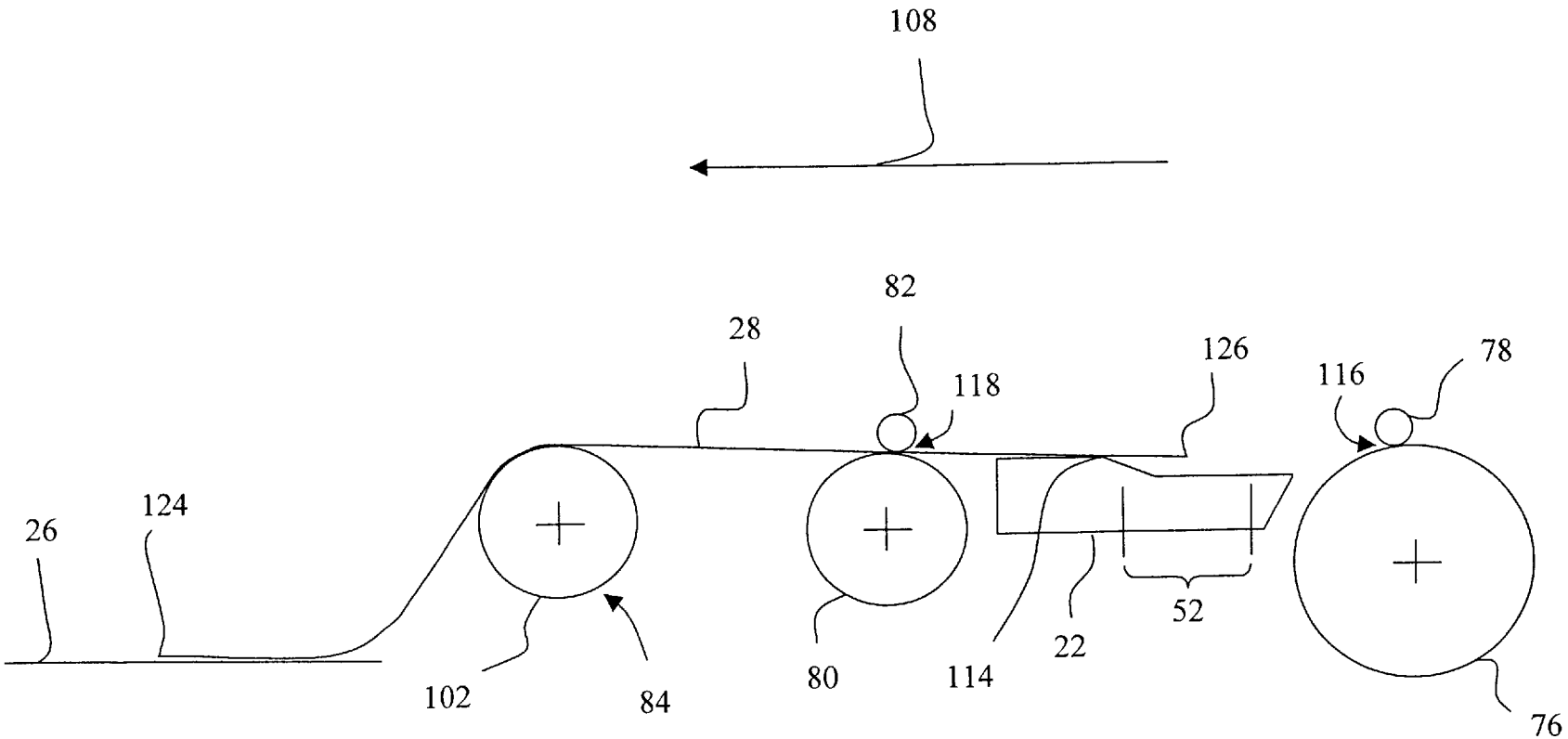
FIG. 5 is a diagrammatic representation of the print media feed system of the imaging apparatus of FIG. 1 showing the conveyance of a sheet of print media over the mid-frame, the exit roller and the rotating support.

FIG. 5 shows the conveyance of the sheet of print media 28 over mid-frame 22, exit roller 80 and rotating support 84. The sheet of print media 28 includes a leading edge 124 and a trailing edge 126. The sheet of print media 28 is shown in a position after trailing edge 126 is released by feed roller 76, i.e., after trailing edge 126 is released from feed roller nip 116. Print media exit pinch roller arrangement 82 is positioned adjacent exit roller 80. Exit roller 80 and exit pinch roller 82 cooperate to advance trailing edge 126 of the sheet of print media 28 through print zone 52. Rotating support surface 102 of rotating support 84 engages a non-printed side of the sheet of print media 28 downstream of exit roller 80 while the trailing edge 126 of the sheet of print media 28 is advanced through print zone 52 by exit roller 80. Accordingly, rotating support 84 permits precise positioning of the sheet of print media 28 in print zone 52 by preventing the lifting of the trailing edge of the sheet of print media in print zone 52 that is caused by the weight of the portion of the sheet of print media 28 that is downstream of exit roller 80.

While the sheet of print media 28 remains in exit roller nip 118, exit roller 80 controls the advancement of the sheet of print media 28, and rotating support 84 does not contribute to advancing trailing edge 126 of the sheet of print media 28 through print zone 52. The reason that rotating support 84 does not contribute to advancing trailing edge 126 of the sheet of print media 28 through print zone 52 is that the coefficient of friction between exit roller 80 and the sheet of print media 28 due to the pressing force applied by exit pinch roller arrangement 82 is much greater than the coefficient of friction between rotating support 84 and the sheet of print media 28 due to gravity and the composition of rotating support tires 100 of rotating support 84.

However, after the sheet of print media 28 is released by exit roller 80 and said exit pinch roller arrangement 82, i.e., the sheet of print media 28 is released from exit roller nip 118, rotating support 84 then contributes to advance the sheet of print media 28 toward and into exit tray 26 due to the coefficient of friction between rotating support 84 and the sheet of print media 28 due to gravity and the composition of rotating support tires 100 of rotating support 84.

While this invention has been described with respect to a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A print media feed system for advancing a sheet of print media having a leading edge and a trailing edge in a sheet feed direction through a print zone in an imaging apparatus, comprising:

a drive unit for providing a rotational force;

a feed roller coupled to said drive unit, said feed roller being positioned upstream from said print zone in relation to said sheet feed direction;

an exit roller coupled to said drive unit, said exit roller being positioned downstream from said print zone in relation to said sheet feed direction;

an exit pinch roller arrangement positioned adjacent said exit roller, said exit roller and said exit pinch roller arrangement cooperating to advance said trailing edge of said sheet of print media through said print zone; and a rotating support coupled to said drive unit, said rotating support being positioned downstream of said exit roller in relation to said sheet feed direction, said rotating support providing a rotating support surface that engages a non-printed side of said sheet of print media downstream of said exit roller while said trailing edge of said sheet of print media is advanced through said print zone by said exit roller, said rotating support not contributing to advance said trailing edge of said sheet of print media through said print zone, but contributing to advance said sheet of print media after said sheet of print media is released by said exit roller.

2. The print media feed system of claim 1, further comprising a mid-frame positioned in said print zone, said mid-frame including a stationary support surface for engaging said non-printed side of said sheet of print media, said exit roller and said exit pinch roller forming a nip, and said stationary support surface and said nip defining a first plane extending toward said rotating support, said rotating support being positioned such that said rotating support surface is tangentially co-planar with said first plane.

3. The print media feed system of claim 2, wherein said exit roller and said rotating support have substantially equal diameters, and wherein said exit roller has a first axis and said rotating support has a second axis, said first axis being vertically spaced by a distance from said second axis.

4. The print media feed system of claim 2, wherein a horizontal plane is associated with at least one of said exit roller and said rotating support, said horizontal plane being non-parallel to said first plane.

5. The print media feed system of claim 1, further comprising a mid-frame positioned in said print zone, said mid-frame including a stationary support surface for engaging said non-printed side of said sheet of print media, said exit roller and said exit pinch roller forming a nip, and said stationary support surface and said nip defining a first plane extending toward said rotating support, said rotating support being positioned such that said rotating support surface is not tangentially co-planar with said first plane.

6. The print media feed system of claim 5, wherein said first plane intersects said rotating support.

7. The print media feed system of claim 5, wherein said nip defines a tangential plane of said exit roller, said tangential plane being tangentially co-planar with said rotating support surface.

8. The print media feed system of claim 5, wherein said exit roller and said rotating support have substantially equal diameters, and wherein said exit roller has a first axis and said rotating support having a second axis, said first axis being vertically spaced by a distance from said second axis.

9. The print media feed system of claim 8, wherein a horizontal plane is associated with at least one of said first axis and said second axis, said horizontal plane being non-parallel to said first plane.

10. The print media feed system of claim 1, wherein said rotating support surface is made of isoprene rubber.

11. An imaging apparatus, comprising:

a printhead defining a print zone; and print media feed system for advancing a sheet of print media having a leading edge and a trailing edge in a sheet feed direction through a print zone in an imaging apparatus, including:

a drive unit for providing a rotational force;

a feed roller coupled to said drive unit, said feed roller being positioned upstream from said print zone in relation to said sheet feed direction;

an exit roller coupled to said drive unit, said exit roller being positioned downstream from said print zone in relation to said sheet feed direction;

an exit pinch roller arrangement positioned adjacent said exit roller, said exit roller and said exit pinch roller arrangement cooperating to advance said trailing edge of said sheet of print media through said print zone; and a rotating support coupled to said drive unit, said rotating support being positioned downstream of said exit roller in relation to said sheet feed direction, said rotating support providing a rotating support surface that engages a non-printed side of said sheet of print media downstream of said exit roller while said trailing edge of said sheet of print media is advanced through said print zone by said exit roller, said rotating support not contributing to advance said trailing edge of said sheet of print media through said print zone, but contributing to advance said sheet of print media after said sheet of print media is released by said exit roller.

12. The imaging apparatus of claim 11, further comprising a mid-frame positioned in said print zone, said mid-frame including a stationary support surface for engaging said non-printed side of said sheet of print media, said exit roller and said exit pinch roller forming a nip, and said stationary support surface and said nip defining a first plane extending toward said rotating support, said rotating support being positioned such that said rotating support surface is tangentially co-planar with said first plane.

13. The imaging apparatus of claim 12, wherein said exit roller and said rotating support have substantially equal diameters, and wherein said exit roller has a first axis and said rotating support has a second axis, said first axis being vertically spaced by a distance from said second axis.

14. The imaging apparatus of claim 12, wherein a horizontal plane is associated with at least one of said exit roller and said rotating support, said horizontal plane being non-parallel to said first plane.

15. The imaging apparatus of 11, further comprising a mid-frame positioned in said print zone, said mid-frame including a stationary support surface for engaging said non-printed side of said sheet of print media, said exit roller and said exit pinch roller forming a nip, and said stationary support surface and said nip defining a first plane extending toward said rotating support, said rotating support being positioned such that said rotating support surface is not tangentially co-planar with said first plane.

16. The imaging apparatus of claim 15, wherein said first plane intersects said rotating support.

17. The imaging apparatus of claim 15, wherein said nip defines a tangential plane of said exit roller, said tangential plane being tangentially co-planar with said rotating support surface.

18. The imaging apparatus of claim 15, wherein said exit roller and said rotating support have substantially equal diameters, and wherein said exit roller has a first axis and said rotating support having a second axis, said first axis being vertically spaced by a distance from said second axis.

19. The imaging apparatus of claim 18, wherein a horizontal plane is associated with at least one of said first axis and said second axis, said horizontal plane being non-parallel to said first plane.

20. The imaging apparatus of claim 11, wherein said rotating support surface is made of isoprene rubber.

* * * * *